US011332217B2

(12) United States Patent
Levy

(10) Patent No.: US 11,332,217 B2
(45) Date of Patent: May 17, 2022

(54) VARIABLE WEIGHT BOAT ANCHOR

(71) Applicant: Peter L. Levy, San Francisco, CA (US)

(72) Inventor: Peter L. Levy, San Francisco, CA (US)

( * ) Notice: Subject to any disclaimer, the term of this patent is extended or adjusted under 35 U.S.C. 154(b) by 0 days.

(21) Appl. No.: 16/878,488

(22) Filed: May 19, 2020

(65) Prior Publication Data

US 2021/0362809 A1 Nov. 25, 2021

(51) Int. Cl.
*B63B 21/24* (2006.01)
*B63B 21/00* (2006.01)

(52) U.S. Cl.
CPC ..... *B63B 21/24* (2013.01); *B63B 2021/003* (2013.01)

(58) Field of Classification Search
CPC ..... B63B 21/22; B63B 2021/003; B63B 2021/004; B63B 21/24; B63B 21/243; B63B 21/246; B63B 21/29; B63B 21/30; B63B 21/38; B63B 21/46
USPC ..... 114/297–299
See application file for complete search history.

(56) References Cited

U.S. PATENT DOCUMENTS 2,413,596 A * 12/1946 Wood, Jr. ..... B63B 21/46 114/299
2,464,661 A * 3/1949 Woodland ..... B63B 21/29 114/297
2,568,006 A * 9/1951 Illsche ..... B63B 21/22 114/299
3,776,172 A * 12/1973 Lambert ..... B63B 21/243 114/298
4,602,588 A * 7/1986 MacLean ..... B63B 21/34 114/301
4,922,847 A * 5/1990 Ryder, Jr. ..... B63B 21/29 114/297
5,188,055 A * 2/1993 Kershner ..... B63B 21/32 114/299
7,882,793 B1 * 2/2011 Paulus ..... B63B 21/24 114/301
2002/0026890 A1 * 3/2002 Zook ..... B63B 21/29 114/294
2005/0241561 A1 * 11/2005 Ruter ..... B63B 21/29 114/294
2009/0304453 A1 * 12/2009 Hardison ..... E02B 3/04 405/224

FOREIGN PATENT DOCUMENTS

DE 3201975 A1 * 8/1983 ..... B63B 21/29

* cited by examiner

*Primary Examiner* — Ajay Vasudeva
(74) *Attorney, Agent, or Firm* — Walt Froloff

(57) ABSTRACT

A variable weight boat anchor having an added weight storage capacity for submerged unloading of added weight is presented. Remote signal from a boat triggers the release of added matter in the anchor for a lighter pulling.

8 Claims, 6 Drawing Sheets

VARIABLE WEIGHT BOAT ANCHOR

BACKGROUND

Field of the Invention

The present invention relates generally to improvements in anchoring small boats. More particularly, the invention relates to an improved form of anchor management, in effect regardless of the nature of the holding, and which at the same time facilitates or allows for ready release and withdrawal or pulling anchor as and when desired with a minimum of human power involved.

Background of the Invention

There is a need to anchor small fishing and pleasure boats and any other forms of water-craft, either permanently or temporarily, in a given position. Such need gives rise to problems that it may become necessary to anchor or moor such craft in various types of holdings. In the past it has been found that an anchor which might be particularly suitable for use in one type or form of holding, as for example sand or mud, may not be as appropriate for another or different type of holding, as for example rock or coral. This has led to a practice to utilize a different form of anchor dependent upon the nature of the holding.

Many different forms of anchor have been employed dependent upon the nature of the holding. That requirement gave rise to problems, regardless of the size of the water-borne craft or the like to be anchored. For obvious reasons it would not be particularly efficient or practical to have a craft operator need to change the type of anchor being used dependent upon circumstances and the nature of the holding below the craft. Moreover, the pulling of anchor after a long day is problematic without a mechanical advantage means, as otherwise more muscle and effort is required and that may be of low availability at the end of the day.

Again in accordance with the known art there has been a tendency for conventional anchors, if disturbed, to roll over and thereafter be disposed on the ocean/sea/river/lake bottom incorrectly, in. Prior art anchors, when so disturbed, would tend to lay on their side and remain that way. Clearly when in such a configuration the efficiency of operation of the overall anchor can be expected to be seriously reduced. Furthermore, when in such a configuration there will be a tendency for the anchor to be dragged across the holding, giving rise to disturbance of sand, mud, dislodgment of rock, destruction of coral etc.

Anchors of this general type usually comprise, as major components, a base member made up of one or more flukes and a shank associated therewith. When such an anchor is totally embedded in a holding, the pressure exerted by the material of such holding on the base member to shank represents a major component of the holding power of the overall anchor. The function of the shank is to transmit force between the base member and the mooring line, chain or cable and becomes problematic when the holding embedded anchor becomes for any reason too heavy to pull on board.

An important parameter for measuring performance is the holding efficiency, or the ratio of the holding power to the weight of the anchor itself. Traditional or swing shank type anchors, additional weight needs to be added to the overall anchor itself, thereby reducing holding efficiency.

What is needed is a light-weight weight anchor when pulling up and plenty heavy when setting down anchor, adjustable for use in different holding conditions, allows for easy initial setting up of the holding, stabilizes against yaw and roll and is also environmentally friendly. Hence what is needed are anchors that are heavy enough to moor a small boat but not so heavy as to place an undue burden on the sailors when it comes time to pull anchor.

SUMMARY

The present invention discloses a variable weight boat anchor adaptable to assist pulling up anchor. A variable weight boat anchor has an anchor base having a housing with a cavity for storage of added anchor weight matter, housing integrated with at least one anchor fluke with the anchor base rigidly coupled to at least one line attachment loop for at least one boat line secured to the anchor line attachment with the anchor base housing having a storage cavity integrated with at least one fluke. A boat anchor drop line coupled to the anchor base loop attached to a release mechanism for unloading added anchor weight matter stored within the anchor housing cavity, and a release mechanism acoustically or mechanically coupled to a remotely initiated trigger such that a trigger can emanate from an anchored boat set to release the added weighted material within the boat anchor cavity to unload the submerged anchor providing a much lighter anchor lift or pull back. The trigger can come in the form of an alternate line which when pulled will initiate a release of the stored matter from the housing cavity volume.

An anchor material unload release mechanism can also come in the form of a water sealed acoustic signal triggered electro-mechanical device release mechanism coupled to an anchor housing cavity door for opening the housing cavity and releasing weighting material upon acoustic signal. The electro-mechanical device releasing mechanism has a transducer responsive to a remote acoustic signal and logic to decode a paired signature signal from without, and to energize a solenoid, motor or pulling gear coupled with a power supply.

BRIEF DESCRIPTION OF DRAWINGS

Specific embodiments of the invention will be described in detail with reference to the following figures.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Objects and Advantages

An object of the invention is to provide an anchor that is equally effective regardless of the type of holding, whether that holding be sand, rock, coral, mud or the like.

Another object of the invention is for anchoring a small boat or the like water-borne vessel at a given locale.

Yet another objective of the invention is to provide an anchor especially suited for use with small fishing and pleasure craft whereby little strength is required to pull the anchor onboard after heaving a much heavier anchor off board.

Another object of the invention is to provide and anchor effective regardless of the type of holding, whether that holding is sand, rock, coral, mud or the like.

Yet another object of the invention is to create variable weight anchors, eliminating some of the inefficient structural weight associated with swing-type or fluke anchors.

The present invention discloses several embodiments for making a variable weight boat anchor. Furthermore in an aspect of the invention, one or more flukes, with and without added matter storage cavities can be integrated with the anchor housing for containment of a releasable heavy weight substance. The weighting substance can be rocks, gravel, aggregate, sand and combinations of these.

Figure 1:
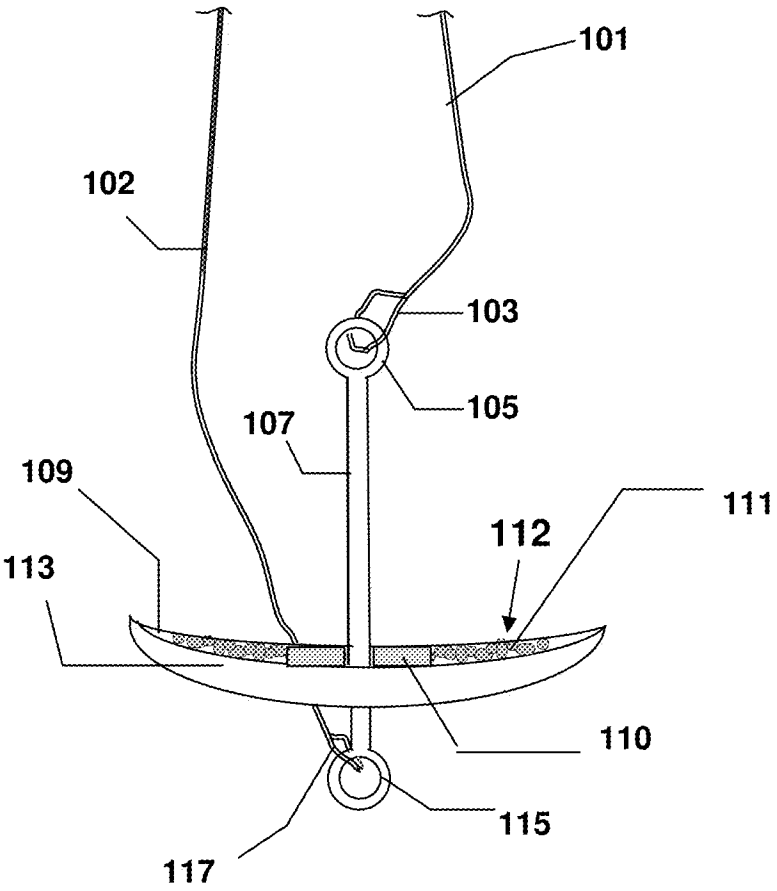
FIG. 1 illustrates a two line semi-hollow fluke variable weight boat anchor in an embodiment of the invention

FIG. 1 illustrates a two line semi-hollow fluke variable weight boat anchor in an embodiment of the invention. In a two line embodiment there are two lines or ropes shown 101 102. An anchor drop line 101 is tied 103 attached to a rigid loop 105 at one end of the anchor body 107 and another line 102, the anchor pull line is tied attached to and opposite end of the anchor body, call it the bottom end. The line 102 attached to the opposite or bottom end of the anchor can be color coded at the boat end so an individual will know to pull on that end for pulling anchor for departure. An emptying mechanism employed in an embodiment of the invention when provide a tug or pull from a boat being anchored, the anchor housing base containing weighting matter will overturn to empty it contents of the loaded material as it is pulled to the boat. Proximate to bottom end 115 of the anchor body 107 are hollowed flukes 113 providing a kind of pocket 111 or volume along each fluke 113 as heavier than water weighting material 112 such as rocks, gravel, aggregate or sand can be stored to provide a securing weight. Upon pulling up anchor, the pull line 102 is lifted. The pulling line 102 can be color coded or of lesser line tension weight to differentiate its function, so that any loose heavy matter 112 contained in the anchor fluke 113 pockets are discarded submerged and a weight matter discarded lighter anchor is pulled up with less weight. The anchor body fluke 113 can have a partial covers 109 110 to reduce unwanted spillage if the anchor is dragged.

An embodiment of a variable weight boat anchor has an anchor base 107 integral with a housing cavity for temporary storage of solid matter integrated with at least one anchor fluke 111, and the anchor base 107 rigidly coupled to at least one line attachment loop 105 for at least one boat line 101 102 secured to the anchor base housing 107 with the anchor base housing storage volume 111 providing a cavity or volume 113 integrated with a fluke 113. A boat anchor drop line 101 is attached to a mechanism to release or unload added weight matter 112 stored within the cavity or volume anchor housing volume 113 while submerged, and a mechanism for releasing stored matter 112 with the release mechanism integrated with a remotely operated trigger. Thus a trigger can emanate from an anchored boat set to release the added weighted material within the boat anchor cavity to unload the submerged anchor providing a much lighter anchor lift or pull back.

Figure 2:
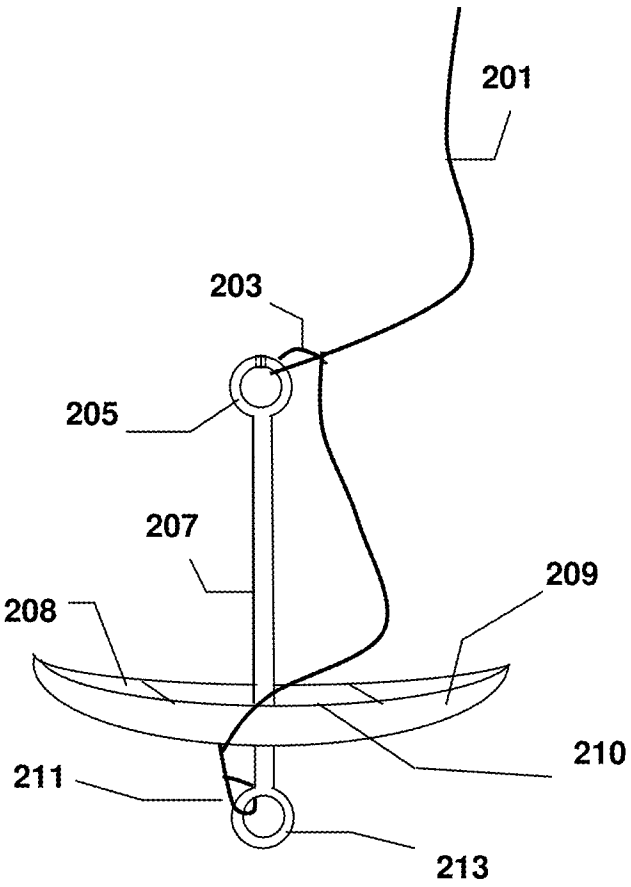
FIG. 2 shows a one line semi-hollow fluke variable weight boat anchor in an embodiment of the invention.

FIG. 2 shows a one anchor line semi-hollow fluke variable weight boat anchor in an embodiment of the invention. An embodiment of a variable weight boat anchor has an anchor base 207 integrated with a storage volume for temporary storage of solid matter. The anchor's at least one anchor fluke 209, and the anchor base 207 rigidly coupled to at least one line coupling loop 205 for at least one boat line 201 secured to the anchor base 207, with the anchor base integrated with a storage volume 210 from a hollow space or cavity within a fluke 209. A boat anchor drop line 201 functions partly as a mechanism to release and unload materials within the fluke 209 integrated storage cavity 210 while submerged.

A release mechanism includes a remotely operated trigger at the line 201 boat end. The trigger can come in the form of the drop anchor line 201 which when pulled in a certain way transfers the line lead 211 to the anchor opposite end 213 and will initiate a release of the stored matter from the storage volume 210 by overturning the anchor. In and embodiment of the invention the integrated fluke 209 may be partially closed with holding surfaces 208 such that the stored matter will not be released from typical anchor water bottom movement. Thus the trigger from an anchored boat sent to release the heavy material within the boat anchor would unload the submerged anchor providing a much lighter anchor lift or pull back.

Figure 3:
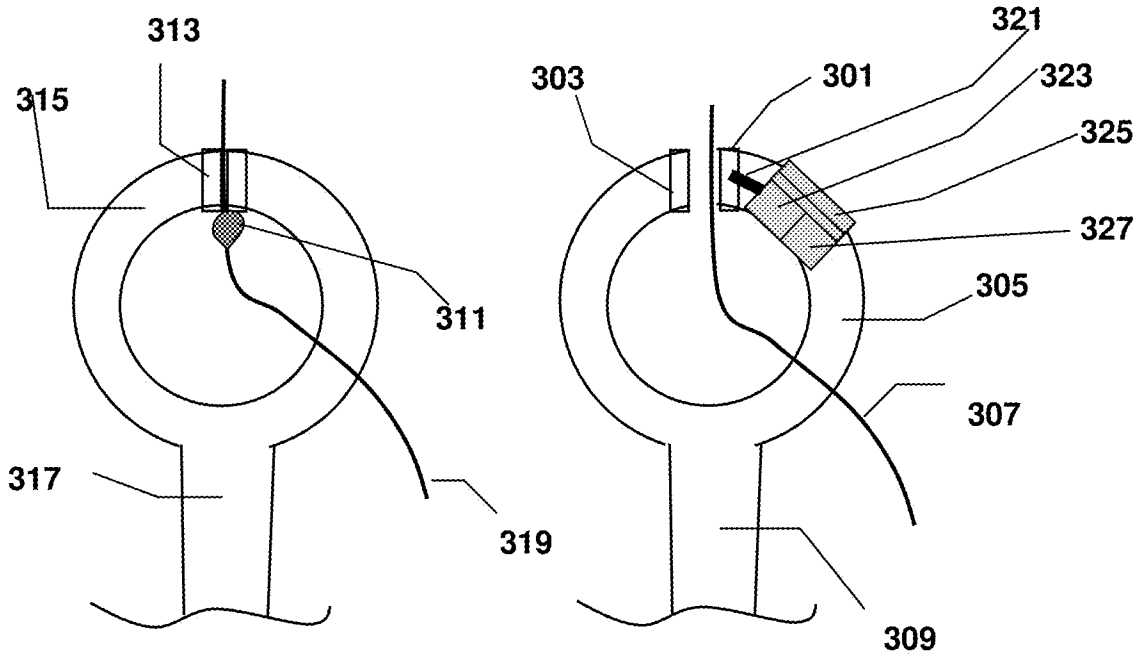
FIG. 3 illustrates release mechanisms of a variable weight boat anchor as an aspect of the invention.

FIG. 3 illustrates anchor content release mechanism of a variable weight boat anchor in an embodiment of the invention. In and aspect of the invention a mechanical release mechanism is shown. A drop anchor line 319 with an upward pull to push a bead 311 or other agent against a spring loaded closure bar 313 integral with an anchor loop 315 rigidly coupled to the anchor body 317 and acts as a simple gate to release the line 319 from the loop 315. The closure bar 313 is integral to the loop 315 and is shown closed firmly holding the line 319 from leaving the loop. The line 319 end is tied coupled to an anchor bottom or content release mechanism from which line 319 freedom from the loop 315 from tension or pull from the boat will initiate the line 319 coupled to the overturning to empty the anchor storage cavity and dispose of the weighting material.

In an alternate embodiment of the invention, an electro mechanical release mechanism is described. The water tight release mechanism will have an acoustic transducer 325 coupled to a power sourced 327 solenoid 323. A sonar signature from the boat will be sensed by the transducer 325 and will energize the solenoid 323 and cause the coupler 321 open a spring loaded closer bar 301 303, shown open, to release the anchor line 307. The line 307 end is tied coupled to an anchor bottom or content release lever from which line 307 freedom from the loop 305 with tension or pull from the boat will initiate the line 307 triggering the release mechanism to empty the anchor storage cavity and dispose of the weighting material.

Figure 4:
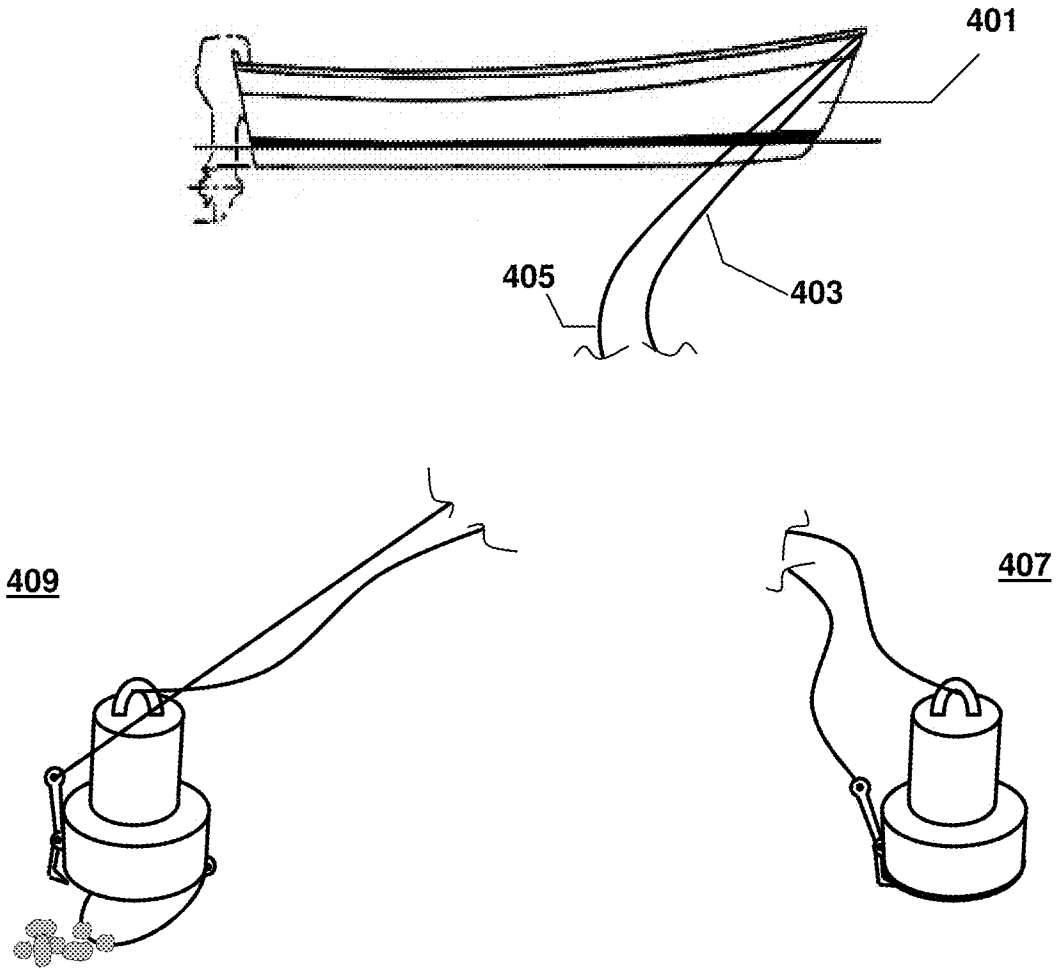
FIG. 4 depicts a hollow anchor housing with bottom opening release mechanism in an embodiment of the invention.

FIG. 4 depicts a hollow anchor housing with bottom opening release mechanism in a two-line embodiment of the invention. A boat 401 on the surface is shown having two lines 403 405, one line to the anchor body 407 409 and the other line to a release mechanism. Slack shown in the two lines 407 depicts the anchor at rest on the water bottom, and a taught pulled line anchor 409 depicts an engaged release mechanism spilling its heavy material out as the anchor is pulled up.

In a very basic embodiment of the invention, there are two ropes or lines: one attached to the top of the anchor and one to metal loop at the bottom. The rope attached to the bottom of the anchor or release lever can be color coded at the boat 401 end so a person can know to pull on that end when leaving. The anchor empties 409 of the loaded material as it is pulled up. The anchor cavity portion of the anchor contains a kind of pocket along each anchor fluke or alternatively an anchor housing volume such that heavy material such as rock, gravel, aggregate, etc. can be contained. When the anchor is ready to be pulled up the color coded rope is pulled first so that the loose heavy material contained in the anchor cavity is discarded and a much lighter anchor is pulled up.

Figure 5:
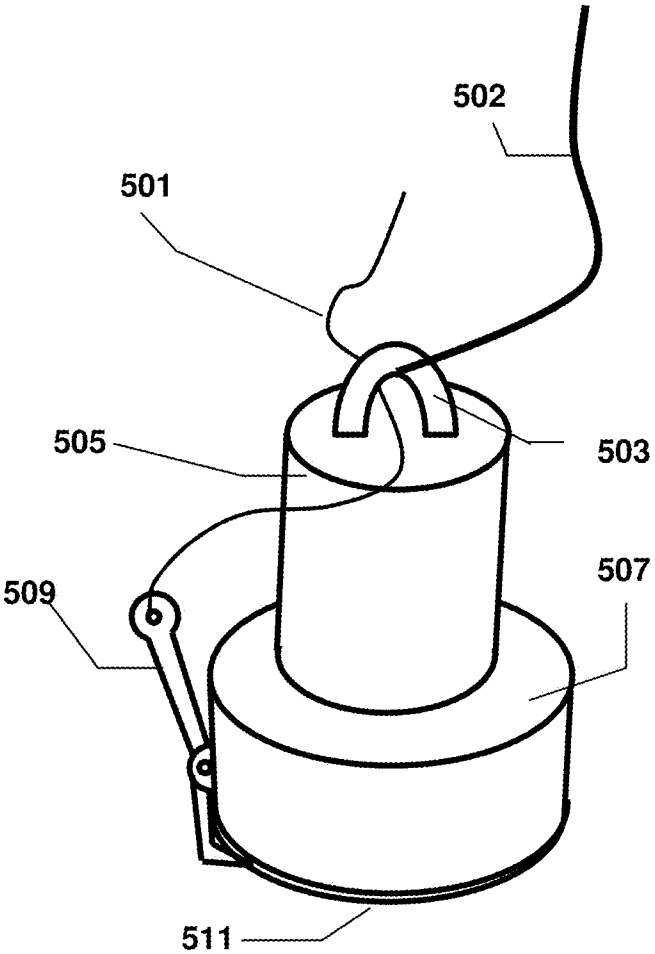
FIG. 5 shows a anchor housing cavity with contained material release mechanism in an embodiment of the invention.
Figure 5:
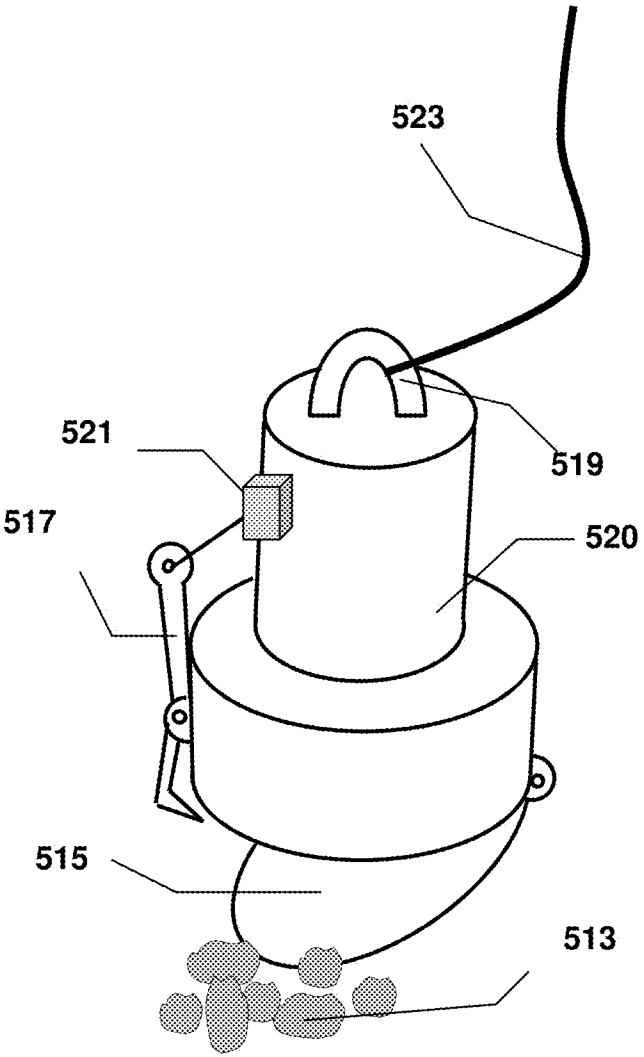

FIG. 5 shows a anchor integrated housing cavity for storage of heavy material and release mechanism in an embodiment of the invention.

A two-line variable weight anchor is shown with the main drop and pull anchor line 502 tried coupled to the anchor loop 503 which is rigidly coupled to a housing 505 and integrated cavity 507. The housing cavity 507 has a closed opening 511 which is opened by lever 509 connected to a release line 501. A pull from a boat above will release the weighty material from inside the housing cavity 507 and draw the anchor to the boat wishing to pull anchor. The release line maybe a much less tension test line as the release opens the cavity 507 and the action of pulling the anchor towards the boat will release the weighting material.

A one-line variable anchor embodiment is shown attached to a single line 523 connected to an loop 519. The loop 519 is coupled to a housing with an internal cavity 520 for storage of weighty matter. Upon triggering with a pairing signature acoustic signal from a boat received by an electro-mechanical device 521 release mechanism coupled to a lever 517 opening 515 the housing cavity 520 and releasing housing storage cavity 520 weighting material 513. The electro-mechanical device 521 releasing mechanism will include a transducer to receive acoustic signal and logic to decode a paired signature signal from a boat to energize a solenoid or pulling gear with a power supply. The device 521 release mechanism will be water tight sealed and coupled to the anchor housing 520.

Figure 6:
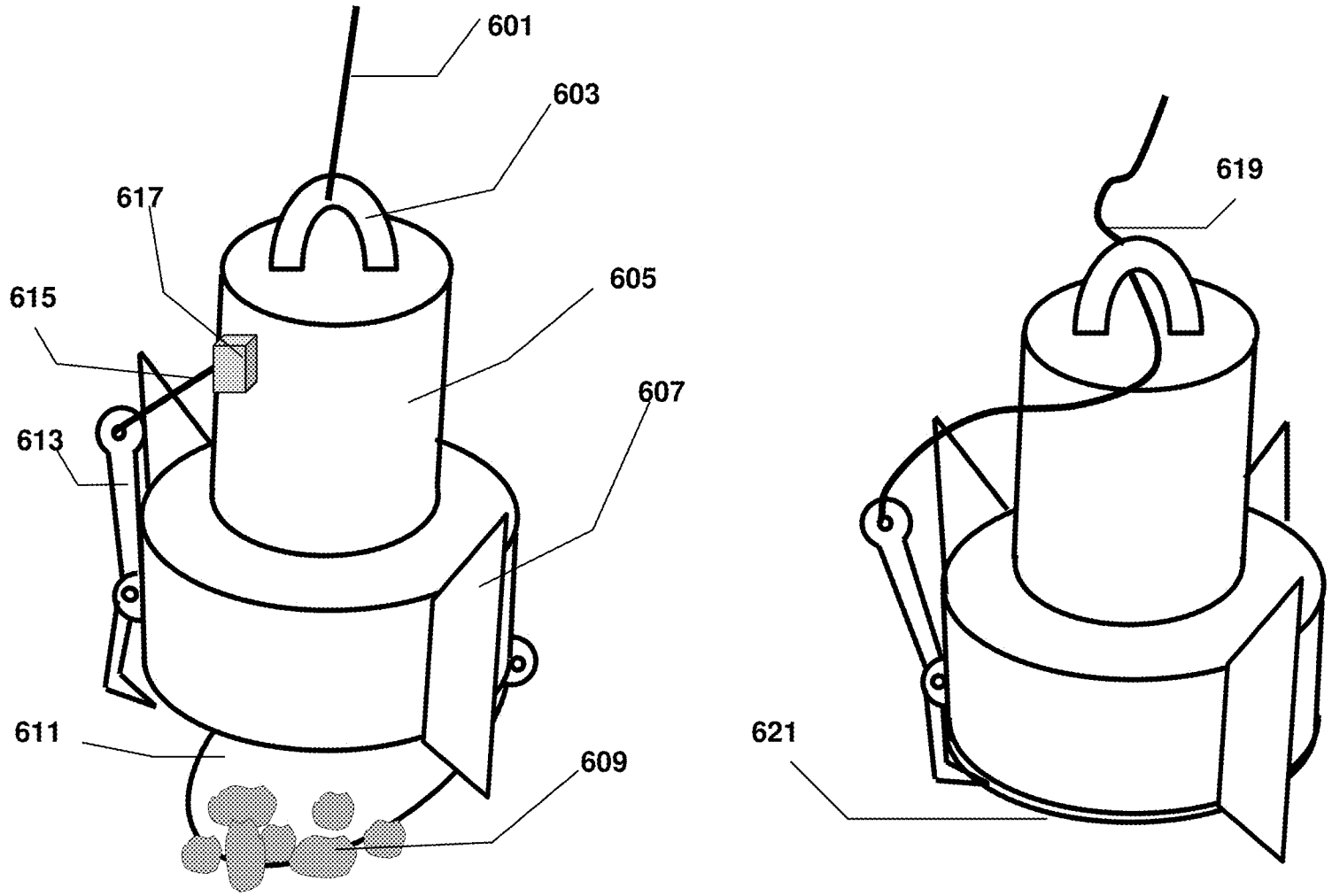
FIG. 6 shows an anchor housing cavity with contained material release mechanism and integrally coupled to flukes in an embodiment of the invention.

FIG. 6 illustrates a one-line variable weight anchor having a body housing cavity with stored material release mechanism and integrally coupled flukes in an embodiment of the invention.

A one-line variable weight anchor is shown with the main drop and pull anchor line 601 coupled to the anchor loop 603 which is rigidly coupled to an anchor body housing 605 having and integrated storage cavity 605. The body housing 607 having an internal storage cavity with a door 611 621 which is opened by lever 613 or alternate mechanical device connected to a release puller 615. A known signature acoustic signal from a boat above will trigger release of the weighty matter 609 from inside the housing cavity 605 and allow drawing the lightened matter-free anchor to the boat signaling to pull anchor. In an embodiment of the invention the release coupler 615 is a component of a electro-mechanical releasing device 617 having an acoustic transducer with logic to receive an authorized trigger from the boat for opening the anchor storage cavity 605 and power with mechanical coupling to open the storage cavity 611 door. The release mechanism and the action of pulling the anchor towards the boat will unload the weighting material and present with a much less weighty anchor for pulling up to the boat. The anchor body 605 is rigidly coupled with one or more flukes 607 to add resistance to movement along certain water body bottoms.

In another embodiment, a one-line variable weight anchor with integrated flukes can use a loop release mechanism whereby by the one-line 619 is used both for the release trigger and for the upward anchor pull.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. A variable weight boat anchor comprising:

an anchor base with housing with a storage cavity providing for adding or removing anchor weight matter, the housing integrated with at least one anchor fluke the storage cavity having a closeable opening;

the anchor base rigidly coupled to at least one anchor line attachment loop for at least one boat anchor line secured to the at least one anchor line attachment loop with the anchor base housing having the storage cavity integrated with the at least one anchor fluke;

the boat anchor line coupled to the anchor line attachment loop attached to a release mechanism to unload the added weight matter within the anchor storage cavity, and the release mechanism acoustically or mechanically coupled to a remotely operated trigger whereby a trigger signal emanating from an anchored boat opens the storage cavity and releases the added weight matter within the boat anchor storage cavity, whereby unloading the submerged anchor provides a much lighter anchor lift or pull back.

2. A variable weight boat anchor as in claim 1 further comprising the remotely operated trigger in the form of an alternate line which when pulled will initiate a release of the stored matter from the storage cavity volume.

3. A variable weight boat anchor as in claim 1 further comprising a second line of lower line tension weight than the anchor line.

4. A variable weight boat anchor as in claim 1 further comprising the anchor line attachment loop with a spring release mechanism such that the released anchor line will overturn or open the storage cavity for release of the added weight matter.

5. A variable weight boat anchor as in claim 1 further comprising the at least one integrated fluke with partially closed fluke storage volume surfaces to reduce unwanted spillage from any bottom shifting or dragging of the anchor.

6. A variable weight boat anchor as in claim 1 further comprising a pulling anchor line which is color coded or of lesser line tension weight to differentiate its function as a trigger to a boat anchor puller.

7. A variable weight boat anchor as in claim 1 further comprising a water sealed acoustic signal triggered an electro-mechanical device release mechanism coupled to a housing cavity door for opening the housing cavity and releasing the weighting matter upon signal, the electro-mechanical device releasing mechanism having a transducer responsive to a remote acoustic signal and logic to decode a paired signature signal from without, and to energize a solenoid, induction motor or pulling gear coupled with a power supply.

8. A variable weight boat anchor as in claim 1 further comprising the at least one flukes integrated with the anchor body housing.

* * * * *